United States Patent [19]
Blackmore
[11] 4,409,766
[45] Oct. 18, 1983

[54] THERMAL INSULATION STRUCTURE

[75] Inventor: Phillip W. Blackmore, Camalachie, Canada

[73] Assignee: Fiberglas Canada Inc., Toronto, Canada

[21] Appl. No.: 253,271

[22] Filed: Apr. 13, 1981

[51] Int. Cl.[3] ..... E04B 1/62

[52] U.S. Cl. ..... 52/169.11; 52/58; 52/742

[58] Field of Search ..... 52/169.11, 169.5, 58, 52/169.1, 404, 742; 428/99

[56] References Cited

U.S. PATENT DOCUMENTS

| | | | |
|---|---|---|---|
| 2,050,798 | 8/1936 | Kothe | 52/169.14 |
| 3,147,570 | 9/1964 | Shanton | 52/169.1 X |
| 3,256,650 | 6/1966 | Weckerly et al. | 52/58 |
| 3,793,795 | 2/1974 | Annand | 52/61 |
| 3,958,373 | 5/1976 | Stewart | 52/58 |
| 3,981,108 | 9/1976 | Berg | 52/61 |
| 4,142,344 | 3/1979 | Palmaer | 52/169.11 X |

FOREIGN PATENT DOCUMENTS

| | | | |
|---|---|---|---|
| 754527 | 3/1967 | Canada | 154/118 |
| 970582 | 7/1975 | Canada | 52/169.11 |
| 2320680 | 11/1973 | Fed. Rep. of Germany | 52/169.11 |

*Primary Examiner*—J. Karl Bell
*Attorney, Agent, or Firm*—Stevens, Davis, Miller & Mosher

[57] ABSTRACT

An exterior insulation layer secured to an above-grade portion of a building basement is protected by a protective sheathing, preferably of impact resistant PVC or the like. The sheathing reaches about 6"–12" below the ground so that the fill of the wall holds the lower end of the sheet in place. The upper portion of the sheeting is directly or indirectly connected to the wall by nails or the like fasteners disposed at a location spaced inwardly of the plane of the exterior of the protective sheet. The advance is in the extreme simplicity and the resulting low cost of the overall insulation of the wall.

19 Claims, 7 Drawing Figures

THERMAL INSULATION STRUCTURE

BACKGROUND OF THE INVENTION

The present invention relates generally to a structure combining insulation and weather-protecting sheet means particularly for application to above-grade portion of the exterior of basement walls.

Weather-resistant and/or insulating structures are known in the art. In Canadian Pat. No. 754,527 are described ready made structural units consisting of synthetic resin foam sheets provided on two sides with sealing material. This structure, however, is not adapted to be installed on vertical building walls such as basement walls as it provides neither any holding means nor any means of weather protection for the upwardly pointing ends of the foam sheets. Furthermore the foam sheets are corrugated on at least one side. U.S. Pat. No. 3,256,650 describes a structure combining an intricate reglet and counterflashing. It does not relate to the flashing itself or to any insulating means. The overall structure is relatively complex and requires considerable skill in application.

SUMMARY OF THE INVENTION

It is, accordingly, the object of the present invention to provide an improved structure for insulating the above-grade portion of the exterior of basement walls.

It is a further object of the present invention to provide an insulation structure consisting of insulation means, protective sheet means and holding means which can be applied readily to any above-grade portion of the exterior of a basement wall.

It is a further object of the present invention to provide an insulation structure which can be installed during construction of a building as well as on a finished building.

It is still a further object of the present invention to provide a weather-resistant and aesthetically pleasing insulation structure of the aforementioned character which is simple and convenient to use and which will give generally efficient and durable service.

In one aspect, the present invention provides, for use in a thermal insulation structure to be applied to the exterior of an above-grade portion of a building basement wall and comprising thermal insulation means adapted to become secured to the wall to thus form a thermally insulating layer on the exterior thereof: protective sheet means, comprising, in combination: a plain, corrugated ribbed or the like sheet section, discrete from thermal insulation means and having a predetermined height; holding means for holding an upper margin portion of the sheet section in a position such that said thermal insulation means is sandwiched between the exterior of a basement wall and said sheet section, when the sheet section is applied; said holding means including a fastener engagement portion adapted for engagement by fastener means for securing said holding means to a basement wall at a location spaced from the plane defined by exterior of a basement wall; said predetermined height of the protective sheet section being selected to be in excess of the height of the above-grade portion of a basement wall to which the protective sheet section is to be applied, to secure that, on application, the sheet section extends below ground level; whereby said sheet section can be held in a position generally parallel with a basement wall generally solely by fastener means remote from exterior of the wall, and by a back fill.

In another aspect, the present invention provides a thermal insulation structure of an above-grade portion of a building basement wall, comprising, in combination: thermal insulation means secured to said basement wall to thus form a thermally insulating layer on the exterior of the basement wall; protective sheet means comprising an integral sheet section of a predetermined height, discrete from said thermal insulation means and installed in close relation to said thermal insulation means; holding means holding an upper margin portion of the sheet section in a position generally coincident with the top of the basement wall, with said thermal insulating layer being sandwiched between the exterior of said basement wall and said sheet; said holding means including a fastener engagement portion engaged by fastener means securing said holding means to said basement wall at a location inwardly spaced from the plane defined by said exterior of the basement wall; said predetermined height of the protective sheet section being in excess of the height of the above-grade portion of said basement wall, thus extending below ground level; whereby said protective sheet section is held in a generally vertical position and generally parallel with said basement wall by said fastener means remote from said exterior of the basement wall, and by the back fill of said basement wall.

The elements of the above combination are preferably made from rigid molded PVC. The integers can also be made of high impact resistant film textured finished PVC. However, the manufacture from aluminum or even from steel is also readily conceivable and within the scope of the present invention.

Preferably, the holding means is integral with the upper margin of said sheet section and is of a generally L-shaped configuration whose foot portion is generally perpendicular to the sheet section to form a ledge portion and whose leg portion is generally parallel with but spaced from the plane of the sheet section, the leg portion extending in a direction away from said upper margin, said leg portion forming said fastener engagement portion. According to another feature of the present invention, said fastener engagement portion is a generally panar ledge portion generally perpendicular to said sheet section and integral therewith along an upper margin thereof.

According to yet another feature of the present invention, the combination may further comprise a protective cap means of a generally L-shaped cross-sectional configuration complementary with a joinder between said sheet section and said ledge portion and adapted to be secured to said ledge portion at a point horizontally spaced from said sheet section.

In accordance with another embodiment of the present invention, the sheet section is a sheet having a generally straight upper edge; said holding means is discrete from said sheet section and is of a generally Z-shaped cross-sectional configuration inclusive a central ledge portion complementary with the sill of a wall, a first lip portion adapted to overlap said sheet section at said upper edge to thus hold the sheet in place, and a second lip portion forming said fastener engagement portion, whereby fastener means can be applied to the protective sheet means at a point vertically upwardly spaced from the sill of a basement wall. The holding means may also be of a generally inverted L-shaped cross-sectional configuration defining a ledge portion complementary with the sill of a wall, and a retaining lip portion adapted to engage said sheet section at said upper edge thereof to retain said sheet section in place, said ledge portion forming said fastener engagement portion.

Contrary to the arrangement of the above Canadian Pat. No. 754,527, the structure of the present invention provides means for holding the insulation and protective sheet means in vertical position in close relation to the basement wall and for protecting the insulation material from atmospheric moisture. Furthermore, when compared with the arrangement of, say, the aforementioned U.S. patent, the structure of the present invention provides simple holding means integrating reglet and counterflashing, thereby improving protection and simplifying the application of the structure. Additionally, the instant structure provides a combination of insulation, weatherproofing and holding means.

BRIEF DESCRIPTION OF THE DRAWINGS

The invention will be described in greater detail by way of several preferred embodiments with reference to the accompanying drawings, wherein.

DETAILED DESCRIPTION OF PREFERRED EMBODIMENTS

Figure 1:
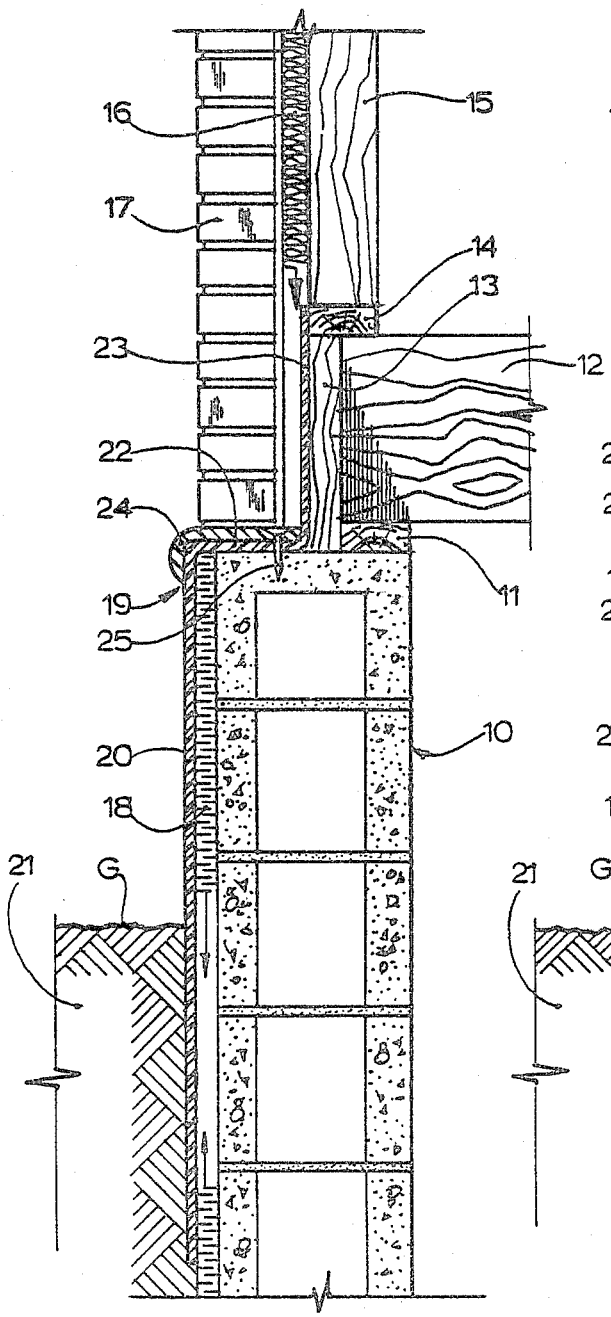
FIG. 1 is a section of a building structure at the basement wall thereof, showing a first embodiment of the present invention.

The invention is shown in all four figures as having been applied to a known basic structure of a typical family home. The known integers of the structure are therefore referred to with the same reference numerals throughout all four figures.

Reference numeral 10 designates a basement wall made of a plurality of molded concrete blocks as is well known. The wall can, of course, be made of poured concrete as well. The top or sill of the wall 10 carries a sill plate 11 on which rests a floor joist 12 whose end is in abutment with a capping 13. Reference numeral 14 designates a floor plate supporting a plurality of wall studs 15, as is well known in the art.

Adhesively secured to the exterior of the building wall represented by the exterior of the capping 13, by the exterior surface of floor plate 14 and by the studs 15 is an insulation layer 16 made of fiberglass or the like thermally insulating material. The insulation layer 16 is sandwiched between the said wall sections and a brick veneer 17.

A second insulation layer 18 is adhered to the exterior surface of the basement wall 10.

The basement insulation layer 18 is held in place and protected by what is generally referred to as protective sheet means 19 whose different embodiments will now be described with reference to the individual figures.

Turning firstly to FIG. 1, the protective sheet means 19 is comprised of a planar protective sheet section 20 made of a high impact resistance film textured finished PVC. The sheet section 20 extends from its top portion, generally coincident with the sill of the basement wall 10, down to approximately 12 inches underneath a fill 21, with the insulation layer 18 sandwiched between the sheet section 20 and the basement wall 10. In the embodiment of FIG. 1, the upper margin of the sheet section 20 is integral with a ledge portion 22 whose inward end is, in turn, integral with an upwardly protruding extension 23. Thus, a generally S-shaped configuration of the protective sheet means is provided. An L-shaped cap 24 extends over the top of ledge 22 and over the upper margin of the sheet section 20. The cap is nailed, through the ledge portion 22, to the sill of the basement wall 10, by a series of nails such as nail 25. The ledge portion 22 is thus also engaged by the fastener 25 and can thus be referred to as a fastener engagement portion. It can be readily appreciated on review of FIG. 1 that the fasteners 25 and the fill 21 form the sole means holding the sheet section 20 in place, while the protective cap 24 provides additional protection of the joinder between the sheet section 20 and the ledge portion 22.

Figure 2:
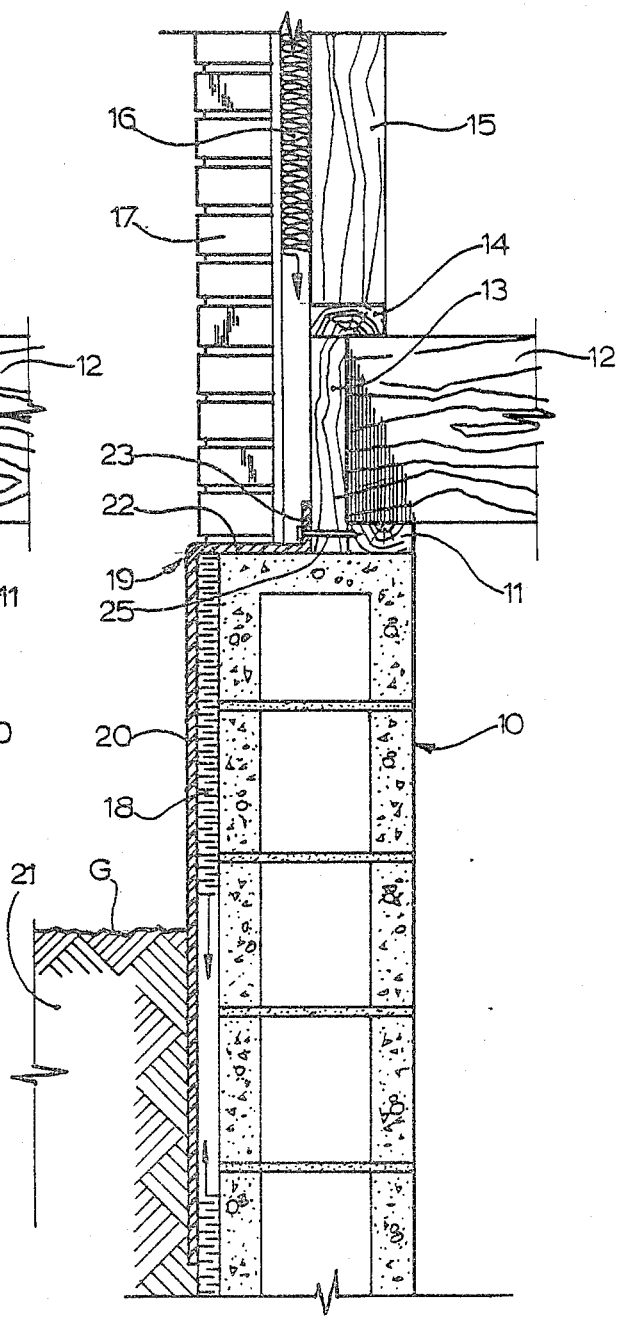
FIGS. 2, 3 and 4, 5, 6 and 7 are sections similar to FIG. 1 but showing different modifications of the invention as shown in FIG. 1.

In a modification of FIG. 2, the sheet section 20 is integral, at its top margin, with a horizontal ledge portion 22 whose upwardly protruding extension 23, however, is considerably shorter than in the embodiment of FIG. 1. The fastener means 25 is a nail which, in this particular embodiment, passes through the capping 13 and through the sill plate 11. Again, the height of the sheet section 20 is in excess of the height of the basement wall 10 above the ground G so that approximately two feet of the weight of the sheet 20 are covered by the fill 21. The embodiment of FIG. 2 has no cap 24.

It will be appreciated on brief review of FIGS. 1 and 2 that the common feature of both these embodiments is that the fastener means (nails 25) are disposed inside of the plane defined by the generally upright sheet section 20 and thus out of reach and protected against weather impact.

Figure 3:
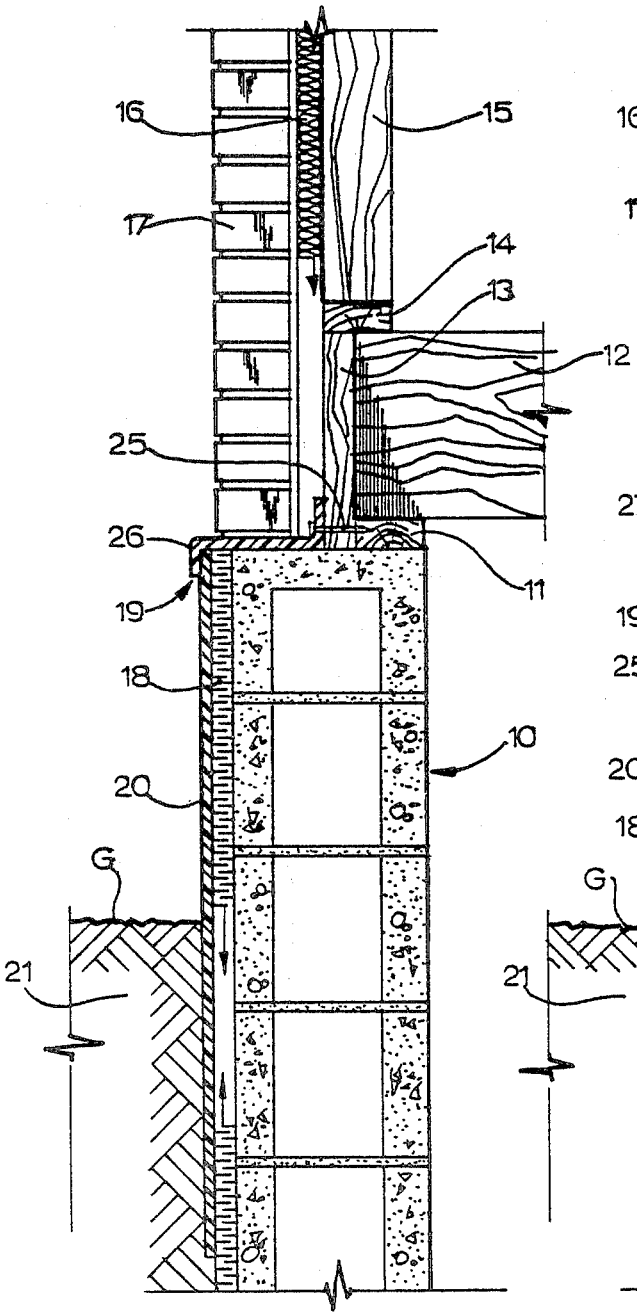
Figure 4:
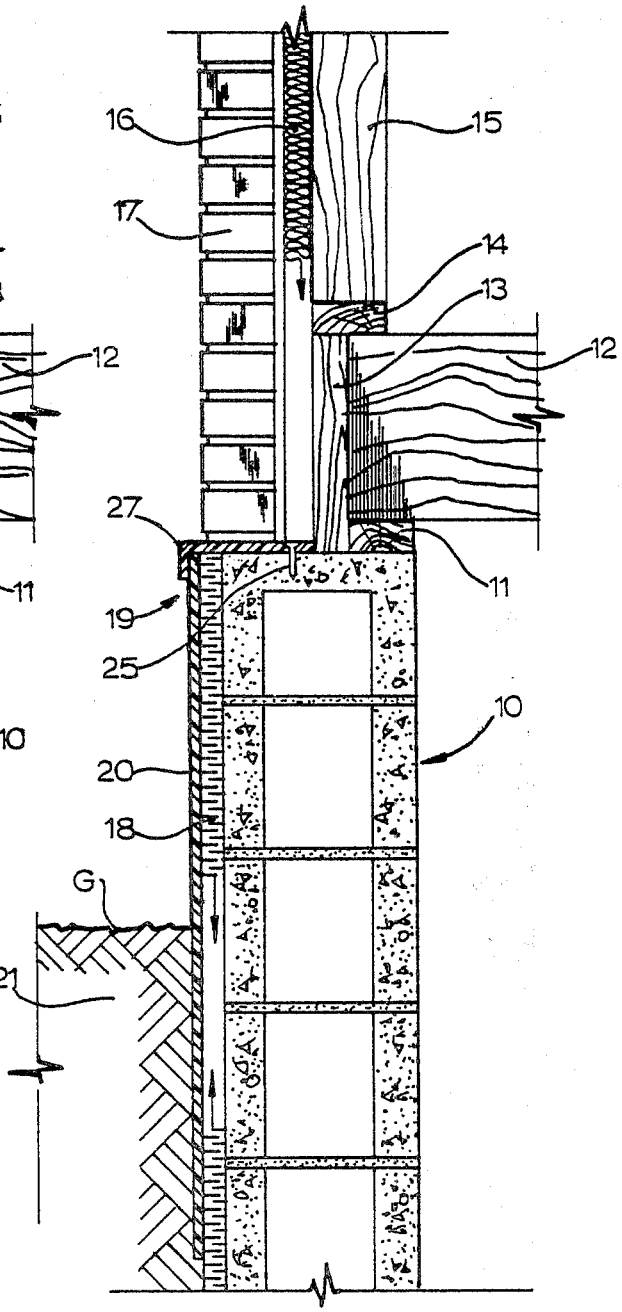

The embodiments of FIGS. 3 and 4 are distinct in that the sheet section 20 is of the type of a generally plain rectangular, planar sheet having an upper edge at generally the same level as the sill of the basement wall 10. A discrete cap 26 (FIG. 3) having a generally S-shaped cross-sectional configuration is disposed on the sill of basement wall 20 and is nailed by nails 25 in a fashion identical to the embodiment of FIG. 2. Thus, the difference between the embodiments of FIG. 3 and FIG. 2 is basically in providing a discrete cap 26 in FIG. 3, whereas the same function is achieved in the embodiment of FIG. 2 by an integral continuation of the sheet 20.

FIG. 4 shows a further simplification of the overall structure wherein a different cap 27 is provided which is only L-shaped such that its leg portion is complementary with the sill of the basement wall 10, while a forward lip section holds the upper margin of the sheet section 20.

Figure 5:
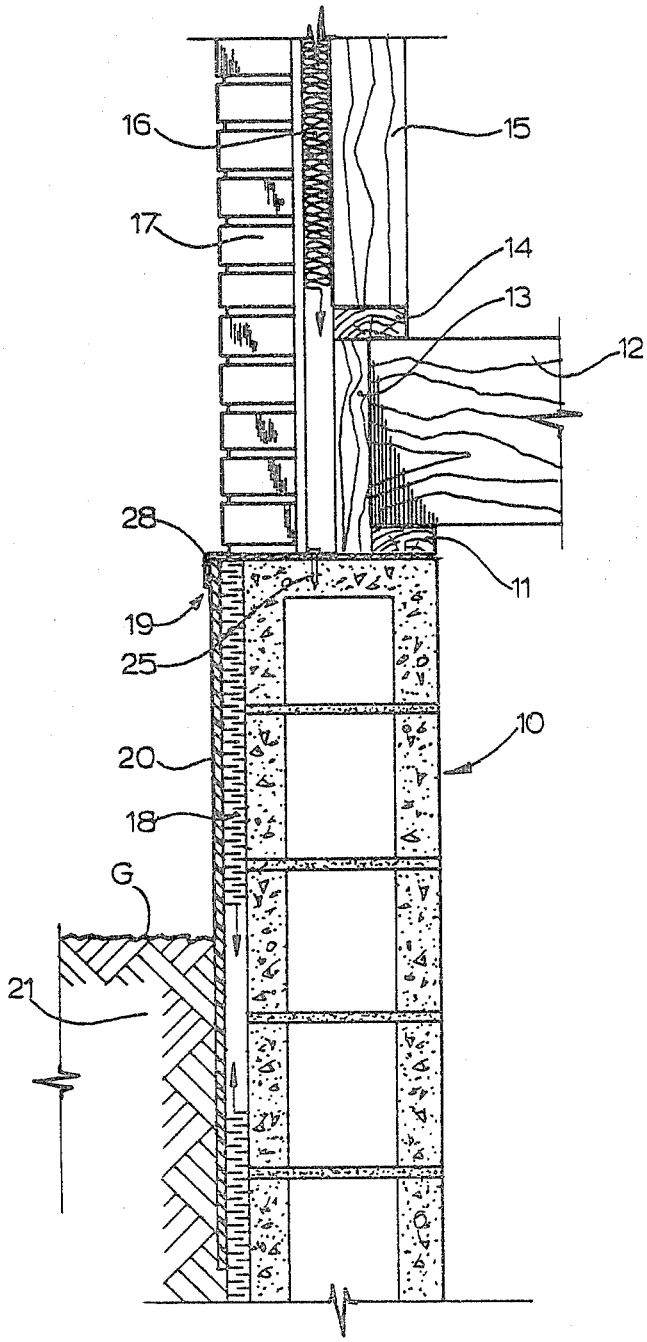

FIG. 5 is similar to the arrangement of FIG. 4 modified in that a molded plastic cap 27 is replaced by a steel cap 28 whose leg portion extends underneath the sill plate 11. Such arrangement provides a particularly strong base for the brick veneer 17.

Figure 6:
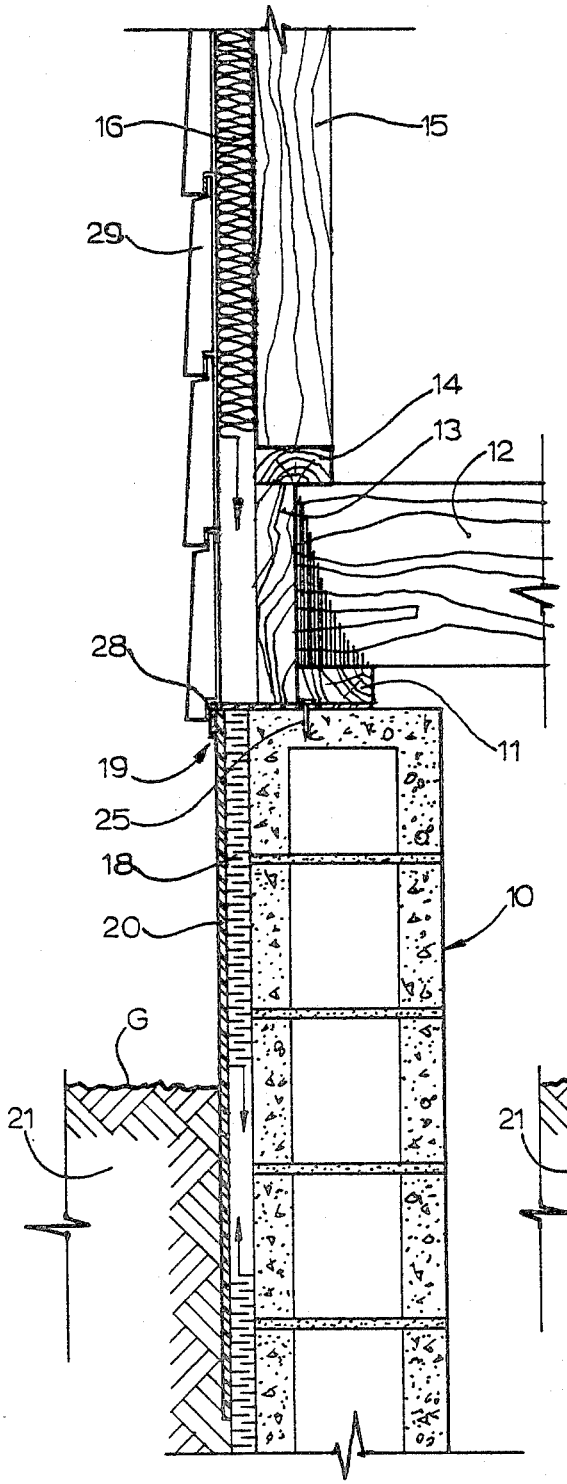
Figure 7:
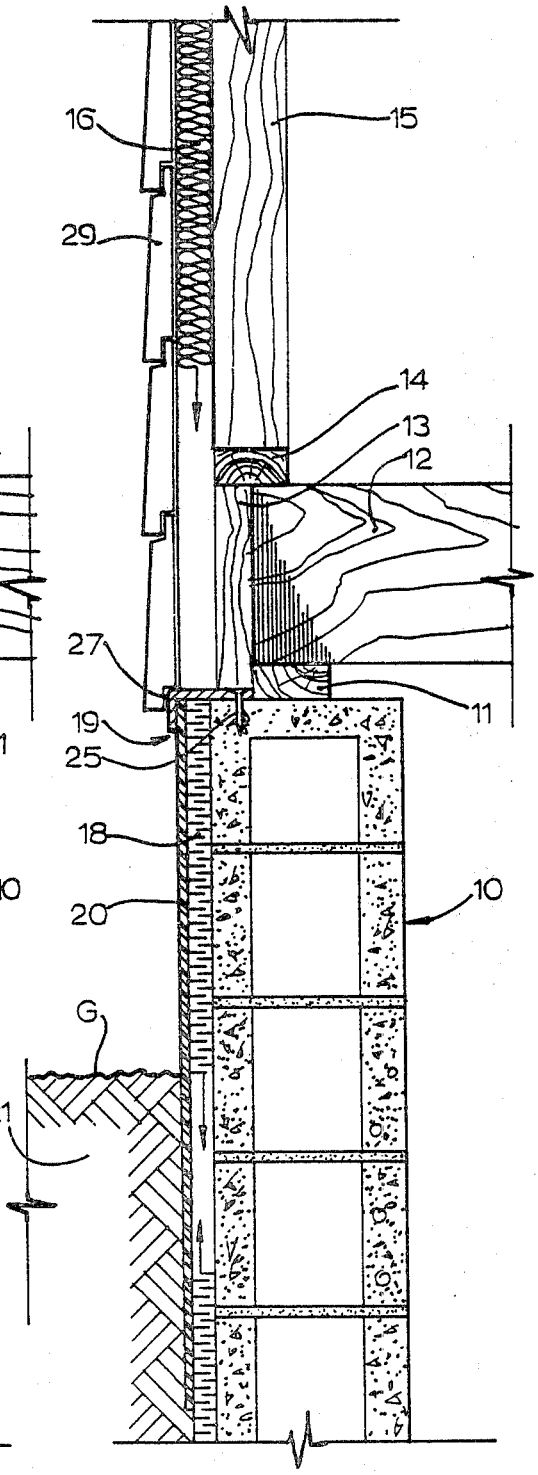

Finally, FIGS. 6 and 7 show the use of the present invention in an arrangement wherein the brick veneer 17 was replaced by aluminum siding 29, the arrangement of the inventive structure corresponding to the embodiment of FIGS. 4 and 5, respectively.

Those skilled in the art will readily conceive further embodiments of the present invention differing from the four examples described above but still falling within the scope of the present invention.

One such readily conceivable embodiment would generally correspond to the arrangement of FIG. 1 without the cap 24 and without the extension 23. In other words, the upper margin of the sheet section 20 would be L-shaped thus providing merely the ledge portion 22 nailed directly to the sill of the basement wall 10 as in FIG. 1. Similarly, an addition of fasteners on the surface of sheet section 20, even though not necessary in most cases, does not depart from the present invention. A still further readily conceivable embodiment is that wherein the cup 26 or 27 of FIGS. 3 or 4, respectively, would have a pair of parallel downwardly dependent lips defining a slot or groove for receiving a sheet 20 therebetween. It follows from the above few examples that present invention. It follows from the above two examples that many modifications of the preferred embodiments may exist without departing from the scope of the present invention as recited in the accompanying claims.

The embodiments of the invention in which an exclusive property or privilege is claimed are defined as follows:

1. For use in a thermal insulation structure to be applied to the exterior of an above-grade portion of a building basement wall and comprising thermal insulation means adapted to become secured to the wall to thus form a thermally insulating layer on the exterior thereof: protective sheet means, comprising, in combination:

(a) a sheet section discrete from thermal insulation means and having a predetermined height;

(b) holding means for holding solely an upper margin portion of the sheet section in a position such that said thermal insulation means is sandwiched between the exterior of a basement wall and said sheet section, when the sheet section is applied;

(c) said holding means including a fastener engagement portion adapted for engagement by fastener means for securing said holding means to a basement wall at a location spaced from the plane defined by exterior of a basement wall;

(d) said predetermined height of the protective sheet section being selected to be in excess of the height of the above-grade portion of a basement wall to which the protective sheet section is to be applied, to secure that, on application, the sheet section extends below ground level;

whereby said sheet section, when installed, is held in a position generally parallel with a basement wall solely by a fastener means remote from exterior of the wall, and by a back fill.

2. Protective sheet means as claimed in claim 1, wherein said holding means is integral with the upper margin of said sheet section and is of a generally L-shaped configuration whose foot portion is generally perpendicular to the sheet section to form a ledge portion and whose leg portion is generally parallel with but spaced from the plane of the sheet section, the leg portion extending in a direction away from said upper margin, said leg portion forming said fastener engagement portion.

3. Protective sheet means as claimed in claim 1, wherein said fastener engagement portion is a generally planar ledge portion generally perpendicular to said sheet section and integral therewith along an upper margin thereof.

4. Protective sheet means as claimed in claim 2 or 3, further comprising a protective cap means of a generally L-shaped cross-sectional configuration complementary with a joinder between said sheet section and said ledge portion and adapted to be secured to said ledge portion at a point horizontally spaced from said sheet section.

5. Protective sheet means as claimed in claim 1, wherein said sheet section is a generally planar sheet having a generally straight upper edge; said holding means is discrete from said sheet section and is of a generally Z-shaped cross-sectional configuration inclusive a central ledge portion complementary with the sill of a wall, a first lip portion adapted to overlap said sheet section at said upper edge to thus hold the sheet in place, and a second lip portion forming said fastener engagement portion, whereby fastener means can be applied to the protective sheet means at a point vertically upwardly spaced from the sill of a basement wall.

6. Protective sheet means as claimed in claim 1, wherein said sheet section is a generally planar sheet having a generally straight upper edge; said holding means being discrete from said sheet section and being of a generally inverted L-shaped cross-sectional configuration defining a ledge portion complementary with the sill of a wall, and a retaining lip portion adapted to engage said sheet section at said upper edge thereof to retain said sheet section in place, said ledge portion forming said fastener engagement portion.

7. A thermal insulation structure of an abovegrade portion of a building base wall, comprising, in combination:

(a) thermal insulation means secured to said basement wall to thus form a thermally insulating layer on the exterior of the basement wall;

(b) protective sheet means comprising a sheet section of a predetermined height, discrete from said thermal insulation means and installed in close relation to said thermal insulation means;

(c) holding means holding solely an upper margin portion of the sheet section in a position generally coincident with the top of the basement wall, with said thermal insulating layer being sandwiched between the exterior of said basement wall and said sheet;

(d) said holding means including a fastener engagement portion engaged by fastener means securing said holding means to said basement wall at a location inwardly spaced from the plane defined by said exterior of the basement wall;

(e) said predetermined height of the protective sheet section being in excess of the height of the above-grade portion of said basement wall, thus extending below ground level;

whereby said protective sheet section is held in a generally vertical position and generally parallel with said basement wall solely by said fastener means remote from said exterior of the basement wall, and by the back fill of said basement wall.

8. A structure as recited in claim 7, wherein said holding means is integral with the upper margin of said sheet section and is of a generally L-shaped configuration whose foot portion is generally perpendicular to the sheet section and forms a ledge integral with a sure portion of the wall, and whose leg portion is generally parallel with but spaced from the plane of the sheet section, the leg portion extending in a direction inwardly and away from said upper margin, said leg portion being engaged by said fastener means thus forming the said fastener engagement portion.

9. A structure as recited in claim 7, wherein said fastener engagement portion is a generally planar ledge portion generally perpendicular to said sheet section and integral therewith.

10. A structure as recited in claim 8 or 9, further comprising a protective cap means of a generally L-shaped cross-sectional configuration complementary with a joinder between said sheet section and said ledge portion and secured to said ledge portion at a point horizontally spaced from said sheet section.

11. A structure as recited in claim 7, wherein said sheet section is a generally planar sheet having a generally straight upper edge; said holding means is discrete from said sheet section and is of a generally Z-shaped cross-sectional configuration including a central ledge portion coincident with the sill of the wall, a first lip portion overlapping said sheet section at said upper edge thus holding the sheet in place, and a second lip portion coincident with said fastener means, said fastener means thus being applied to the protective sheet means at a point vertically upwardly spaced from the sill of the basement wall.

12. A structure as recited in claim 7, wherein said sheet section is a generally planar sheet having a generally straight upper edge; said holding means is discrete from said sheet section and is of a generally inversely L-shaped cross-sectional configuration defining a ledge portion generally coincident with the sill of the wall, and a retaining lip portion engaging said sheet section at said upper edge thereof to maintain said sheet section in place, said ledge portion being operatively associated with the fastener means thus forming said fastener engagement portion.

13. Protective sheet means as claimed in claims 2 or 3, further comprising a protective cap means of a generally L-shaped cross-sectional configuration complementary with a joinder between said sheet section and said ledge portion and adapted to be secured to said ledge portion at a point horizontally spaced from said sheet section, said "L-shaped cap means being a rigid molded PVC perimeter cap."

14. A structure as recited in claim 8 or 9, further comprising a protective cap means of a generally L-shaped cross-sectional configuration complementary with a joinder between said sheet section and said ledge portion and secured to said ledge portion at a point horizontally spaced from said sheet section, said L-shaped cap means being a rigid molded PVC perimeter cap.

15. The invention as recited in claim 1 or 7, wherein said protective sheet means and said holding means are weather-resistant.

16. The invention as claimed in claim 1 or 7, wherein said protective sheet means and/or said holding means is made of high impact resistant film textured finished PVC.

17. The invention as recited in claim 1 or 7, wherein said protective sheet means and/or said holding means is made of aluminum.

18. The invention as recited in claim 1 or 7, wherein said protective sheet means and/or said holding means is made of steel.

19. The invention as recited in claim 12, wherein said holding means is made of steel and wherein the ledge portion reaches underneath a sill plate of a basement wall.

* * * * *